US006092715A

United States Patent [19]

Correll

[11] Patent Number: 6,092,715

[45] Date of Patent: Jul. 25, 2000

[54] EASY-TO-USE PIZZA BOX

[76] Inventor: John D. Correll, 8459 Holly Dr., Canton, Mich. 48187

[21] Appl. No.: 09/260,619

[22] Filed: Mar. 1, 1999

[51] Int. Cl.[7] ..... B65D 5/24

[52] U.S. Cl. ..... 229/110; 229/152; 229/906

[58] Field of Search ..... 229/109, 110, 229/152, 902, 906, 160.2, 920, 931

[56] References Cited

U.S. PATENT DOCUMENTS

| | | | |
|---|---|---|---|
| 4,765,534 | 8/1988 | Zion et al. | 229/109 |
| 4,809,908 | 3/1989 | Keefe et al. | 229/150 |
| 5,000,374 | 3/1991 | Deiger | 229/109 |
| 5,110,039 | 5/1992 | Philips | 229/110 |
| 5,125,566 | 6/1992 | Deiger | 229/110 |
| 5,211,329 | 5/1993 | Patton | 229/110 |
| 5,368,225 | 11/1994 | Ritter | 229/110 |
| 5,402,929 | 4/1995 | Ritter et al. | 229/110 |
| 5,452,845 | 9/1995 | Ritter | 229/906 |
| 5,553,771 | 9/1996 | Correll | 229/110 |
| 5,702,054 | 12/1997 | Philips et al. | 229/110 |

OTHER PUBLICATIONS

Photo 1: A Blank of a Pizza Box Used by a Pizza Company. Photographer J. Correll, Aug. 1996.

*Primary Examiner*—Gary E. Elkins

[57] ABSTRACT

A pizza carton having an improved side wall structure and improved cover structure for a D-type box, an improved structural arrangement of major and minor diagonal walls, an improved fold line structure containing a pressure-releasing slit, and an easy-grasp tab on the cover.

24 Claims, 3 Drawing Sheets

10
90
86
98
98
88
100
80
96
96
82
84
50
24
52
61
28
30
32
20
99
34
38
46
44
36
48
26
54
64
40
22
62
68
66
42
56

EASY-TO-USE PIZZA BOX

FIELD OF THE INVENTION

This invention relates to cartons made of foldable material and, in particular, to blanks and boxes for food products, such as pizza.

DESCRIPTION OF THE PRIOR ART

Prior art structure for pizza boxes can be defined in terms of box shape, or number and length of walls used in the carton. There are three predominant box shapes used in the pizza industry. The first is a square box. This carton has front, rear, left side, and right side walls all of equal length.

The second shape is an octagonal box. This carton has front and rear walls of equal length, left and right side walls of equal length, and four diagonal wall structures. The most common octagonal box is disclosed in Zion et al. U.S. Pat. No. 4,765,534 granted Aug. 23, 1988. This box is often referred to as the "octabox." Another octagonal box is shown in Deiger U.S. Pat. No. 5,000,374 granted Mar. 19, 1991.

The third pizza box shape, which evolved from the octagonal shape, is an hexagonal box with square corners in the rear. This carton has a full-width rear wall, a front wall of shorter width than the rear wall, and left and right side wall structures extending between the rear wall and front wall. Each side wall structure comprises a side wall and one or more diagonal wall panels extending between the side wall and the front wall. From top view, the shape of the box resembles a capital "D." As a result, this shape of box is often referred to as a "D-type box." Structures used in making a D-type box include Philips U.S. Pat. No. 5,110,039 granted May 5, 1992; Patton U.S. Pat. No. 5,211,329 granted May 18, 1993; Ritter et al. U.S. Pat. No. 5,402,929 granted Apr. 4, 1995; Correll U.S. Pat. No. 5,553,771 granted Sep. 10, 1996; and Philips et al. U.S. Pat. No. 5,702,054 granted Dec. 30, 1997.

The most widely-used D-type box is that disclosed in Philips et al. U.S. Pat. No. 5,702,054. Currently this box is used throughout the Domino's Pizza system. To form the unique D-shape of this carton, each of the left and right side wall structures consists of a side wall, a major diagonal wall attached to a front end of the side wall, a minor diagonal wall attached to an end of the front wall, and a connector panel attached to a bottom edge of each of the diagonal walls and to the bottom panel. The rear end of the side wall is free of attachment.

The Philips et al. '054 box further includes a cover consisting of a cover panel, a cover front flap, and opposing cover side flap structures. Each of the side flap structures consists of a major flap attached to a side edge of the cover panel and a minor flap attached to a rear end of the major flap. The major flap is disposed exterior to the side wall and the minor flap is disposed interior and parallel to the rear wall. All total, the cover of this box has five flaps.

However, even though the Philips et al. '054 box is widely used, it is also time-consuming and inconvenient. For a box to be easy to use, it must (a) be capable of being easily and quickly erected from a blank into a box, (b) be capable of being opened easily with one hand, (c) be capable of being easily and quickly closed from a partially-erected format, and (d) be capable of being easily grasped from a line-up of vertically disposed boxes standing on a side. Some boxes accomplish some of those requirements, but no D-type box accomplishes all of them.

To reduce the time and complexity of folding and closing a D-type pizza box, the folding and closing procedures must involve only a minimal number of movements. To create that minimal number of movements, the box must have a minimal number of cover flaps requiring folding and positioning.

There are examples of rectangular and octagonal boxes having only one cover flap (i.e., Zion et al. '534 and Deiger '374 provide octagonal examples). However, there are no prior art D-type boxes having a cover with only one flap. As noted, the cover of the Philips et al. '054 box has a total of five flaps. This results in intricate manipulations when folding and closing the box and, thereby, is time-consuming and inconvenient. The other D-type boxes also have a plurality of cover flaps. Therefore, it would be desirable to have a D-type box with a cover containing only a single cover flap.

To also enable easy folding, the panels of the box must be erectable with a minimal amount of resistance or spring-back. In the Philips et al. '054 box, considerable resistance occurs when folding the front wall to upright position. This resistance is created as a result of three fold lines converging at a single junction, or vertex point. That vertex point is where the front wall, a minor diagonal wall, and a connector panel converge. Considerable pressure occurs at the vertex point, resulting in substantial spring-back in the front wall. Therefore, to create easier folding, it would be desirable to have a D-type box with a special fold line structure that relieves the pressure build-up at the vertex point of an end wall, minor diagonal wall, and connector panel.

In addition to easy folding and cover closing, to be fully convenient a box must be capable of being easily extracted from a line-up of vertically disposed boxes. To accomplish this a box must have a structure that enables it to be easily grasped at the front with one hand. With a standard square box, this is accomplished by leaving the cover front flap projecting outward. However, this can't be done with the Philips et al. '054 box because it's a folder style box, which necessitates that the cover front flap be tucked inside the box to keep the box closed. Therefore, it would be desirable to have a means for easily grasping the Philips et al. '054 style of D-type box from a line-up of boxes.

Some prior art boxes have a semi-circular tab projecting from a front edge of the cover panel. One might assume that this could be used for grasping when extracting a box from a line-up of vertically disposed cartons. However, this tab is inconvenient for that purpose because it's too small to be securely grasped between the thumb and index finger. Typically, this tab is created from a 1-inch diameter semi-circle and, therefore, extends only one-half inch or less beyond the front edge of the cover panel. This is adequate for opening the cover but not for grasping the box and extracting it from a line-up of boxes. It is worth noting that although the cover-opening tab exists on square boxes, none exists on a D-type box. An example of this cover-opening tab on a square box is shown in Keefe et al. U.S. Pat. No. 4,809,908 granted Mar. 7, 1989.

In summary, there is a need for a D-type box that's easy to use, specifically easier to use than other D-type boxes and, in particular, easier to use than the box of Philips et al. U.S. Pat. No. 5,702,054. My invention solves this need by providing a box that can be quickly and easily erected from a blank into a box, can be quickly and easily opened with one hand, can be quickly and easily closed, and can be easily extracted from a line-up of vertically disposed boxes. By solving this need, a time-saving, hassle-reducing box is provided for the pizza industry.

In conclusion, it would be highly desirable to provide a D-type pizza box that overcomes the above-described problems and disadvantages.

OBJECT AND ADVANTAGES

Accordingly, the object of my invention is an easy-to-use pizza box and, specifically, an easy-to-use D-type box. As a result of a unique side wall structure in combination with a unique D-shape cover panel, my unique D-type box provides one or more of the following advantages over other styles of D-type boxes:

1) Easy, quick set-up of the box from a blank and easy, quick closure of the box due to the cover panel having free side edges and free diagonal edges and only a single cover flap attached at a front edge;
2) Easy extraction of the box from a line-up of vertically disposed boxes and easy, quick opening of the box with one hand due to an easy-grasp tab overlapping the front edge of the box.

Further objects and advantages of the invention will become apparent from consideration of the following detailed description, related drawings, and appended claims.

SUMMARY OF THE INVENTION

In accordance with the invention, a blank and related box are created that incorporate one or more of the following structures:

1) A unique cover structure for a D-type box, that structure comprising a D-shape cover panel having free side edges and free diagonal edges and a cover flap attached to a front edge;
2) A unique side wall structure for a D-type box, that structure comprising (a) a side wall attached to a bottom panel, (b) a major diagonal wall attached to a front end of the side wall, (c) a minor diagonal wall attached to an end of a front wall, (d) a connector panel attached to a bottom edge of each of the diagonal walls, and (e) a free-swinging corner flap attached to a rear end of the side wall;
3) A unique structural arrangement of major and minor diagonal walls whereby (a) the minor diagonal wall abuts an end of the major diagonal wall or (b) an end of the major diagonal wall is adjacent the minor diagonal wall or (c) both;
4) An easy-grasp tab at the front edge of the cover panel, that tab being at least 35 millimeters wide and 18 millimeters deep (from front edge to cover front flap fold line);
5) A unique fold line structure for relieving pressure at a vertex point where a bottom edge of an end wall converges with a side edge of a minor diagonal wall, that fold line structure comprising a pressure-releasing slit disposed at an end of the fold line joining the end wall to a bottom panel.

My invention typically would be used for packaging relatively flat food products such as pizza; however, it could take other forms for other purposes, as well.

A complete understanding of the invention can be obtained from the detailed description that follows.

LIST OF REFERENCE NUMERALS

Figure 1:
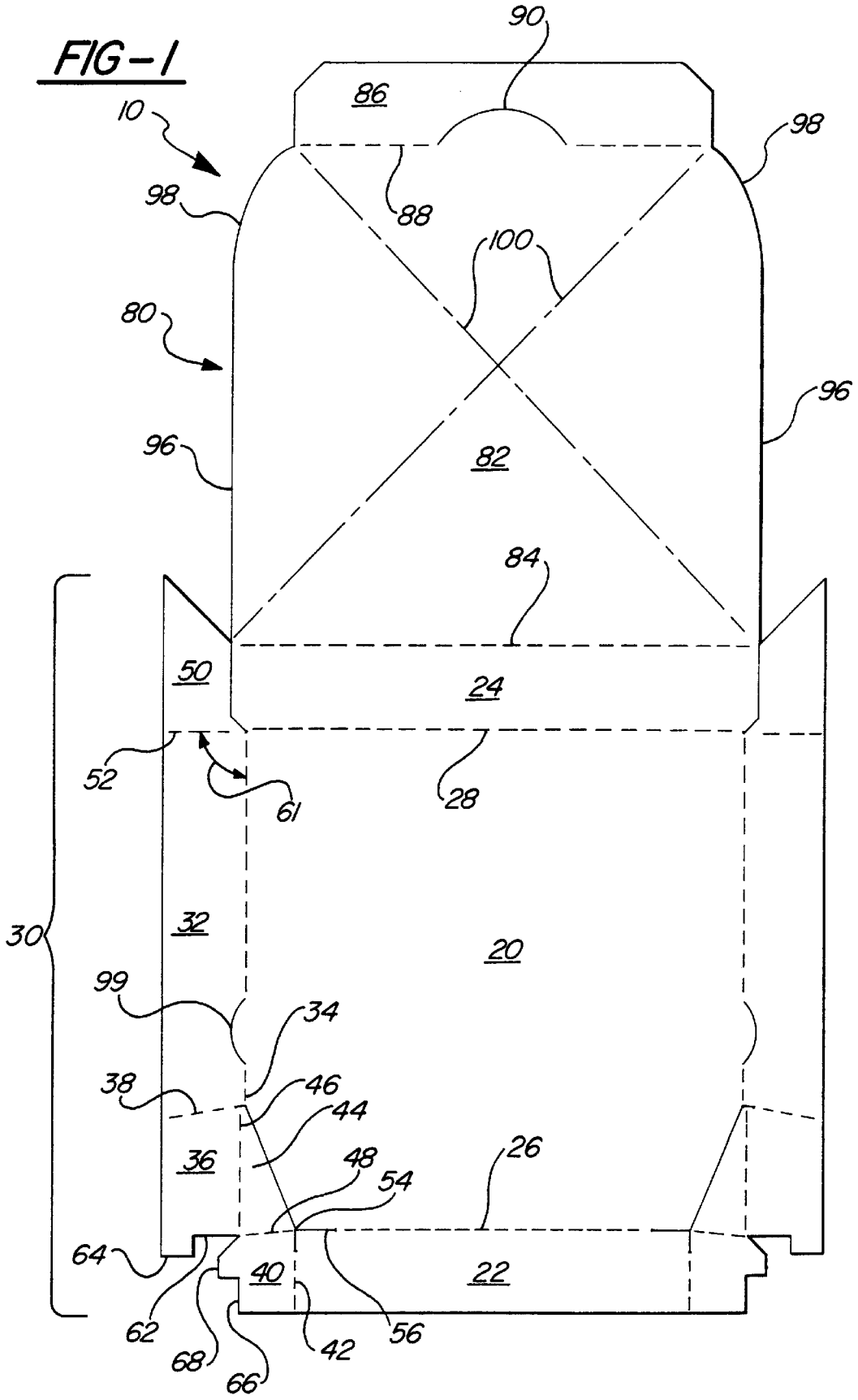
FIG. 1 is a plan view of a blank of the preferred embodiment of the invention.

Between drawings, like reference numerals designate corresponding parts.

10 blank of the preferred embodiment
12 box of the preferred embodiment
20 bottom panel
22 front wall
24 rear wall
26 fold line
28 fold line
30 side wall structure
32 side wall
34 fold line
36 major diagonal wall
38 fold line
40 minor diagonal wall
42 fold line
44 connector panel
46 fold line
48 fold line
50 corner flap
52 fold line
54 vertex point
56 pressure-releasing slit
58 gap
60 obtuse angle
61 obtuse angle
62 inward portion of end edge
64 outward portion of end edge
66 inward portion of end edge
68 outward portion of end edge
70 imaginary line of projection
80 cover
82 cover panel
84 rear edge of cover panel (and fold line)
86 cover front flap
88 fold line
90 easy-grasp tab
92 width of tab
94 depth of tab
96 free side edge
98 free diagonal edge
99 stand-up tab
100 anti-warp score lines

DESCRIPTION OF THE PREFERRED EMBODIMENT

Referring now to the drawings, there is illustrated a preferred embodiment of the invention in the format of a one-piece paperboard blank and, correspondingly, in the format of a box created from the blank. The intended use for the embodiment is as a food carton or, specifically, a pizza box. However, it will be appreciated, as the description proceeds, that my invention may be realized in different embodiments and may be used in other applications.

Figure 2:
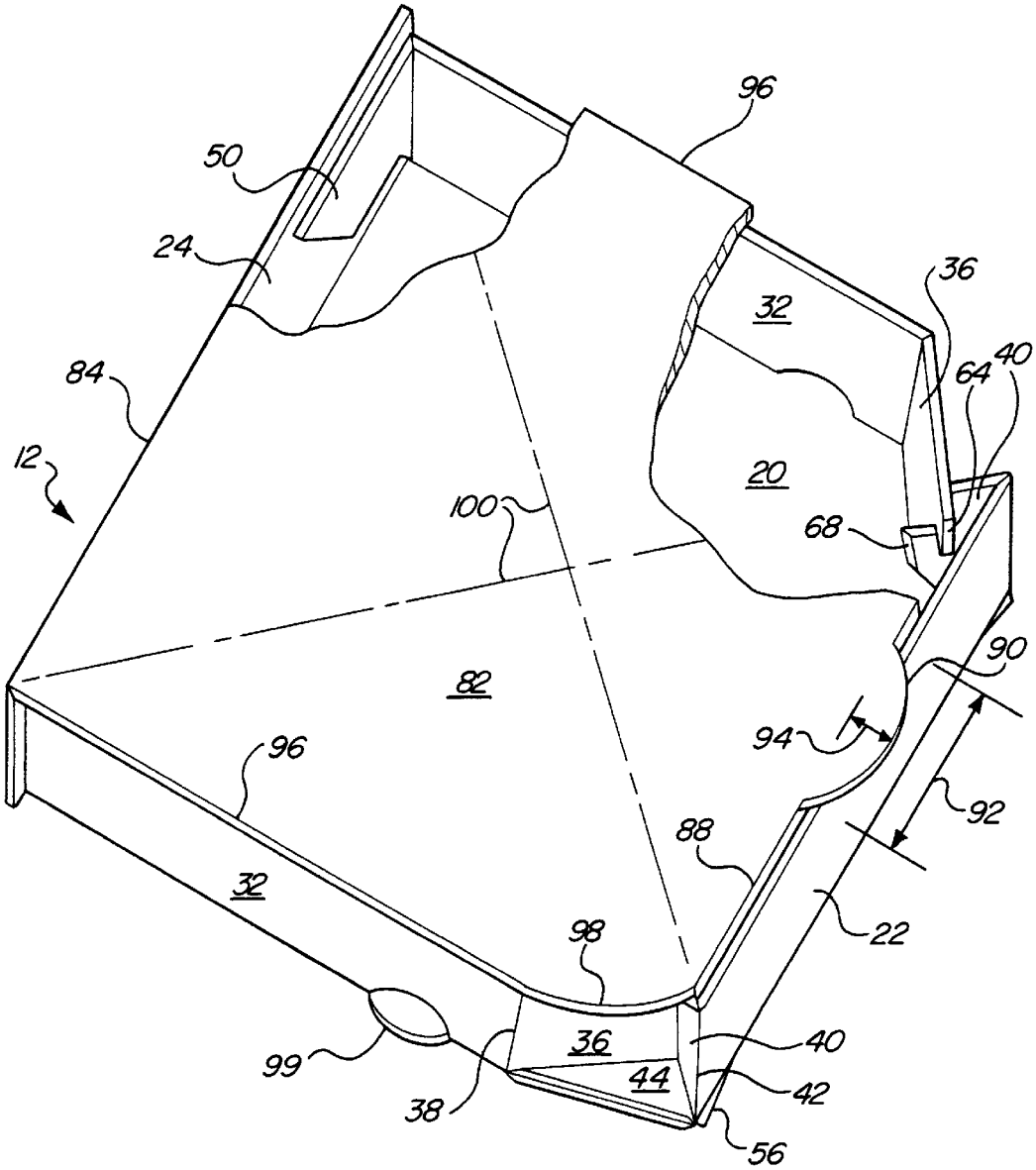
FIG. 2 is a perspective view of a box formed from the blank.

FIG. 1 shows a blank 10 and FIG. 2 shows a box 12 created from blank 10. Referenced components are labeled in FIG. 1; selected components are labeled in other Figures. Corresponding parts between drawings share a same reference numeral. It is noted that the invention is bilaterally symmetrical. Therefore, for simplicity of labeling, some components are indicated by numerals on one side of the drawing only. When this occurs, it is to be understood that the discussion also applies to the corresponding components on the other side, even though those components may not be labeled.

STRUCTURE OF THE INVENTION

Referring now to the drawings and particularly to blank 10 shown in FIG. 1, the blank and corresponding box 12 have a bottom panel 20, front and rear walls 22, 24 hingedly attached to bottom panel 20 at fold lines 26, 28, respectively.

A pair of unique opposing side wall structures 30 each comprise a side wall 32 hingedly attached to bottom panel 20 at fold line 34, a major diagonal wall 36 hingedly attached to a front end of side wall 32 at fold line 38, a minor diagonal wall 40 hingedly attached to an end of front wall 22 at fold line 42, a connector panel 44 hingedly attached to a bottom edge of diagonal panels 36, 40 at fold lines 46, 48, respectively, and a corner flap 50 hingedly attached to a rear end of side wall 32 at fold line 52. There is a vertex point 54 where fold lines 26, 42, and 48 converge.

Several of the unique features of side wall structure 30 should be noted.

Figure 4:
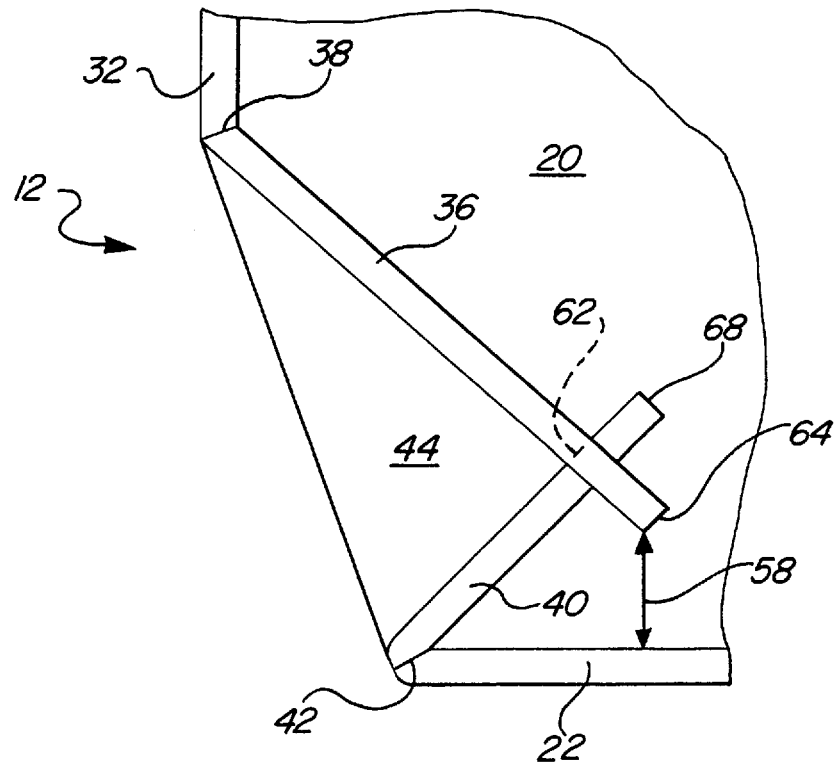
FIG. 4 is a top view of a front corner section of the box.

First, as can be seen in FIG. 4, the length of major diagonal wall 36 is such that the wall does not extend all the way to front wall 22, thereby allowing a gap 58 between the end edge of the diagonal wall (indicated by numeral 64) and the front wall. In the embodiment, the distance of gap 58 is at least six millimeters. This structural arrangement facilitates quick cover closure by allowing a large space for insertion of the cover front flap into the box cavity without hitting the major diagonal wall. (Description of cover structure is provided below.)

Second, connector panel 44 is free of attachment to bottom panel 20. This facilitates reduced pressure between panels 20 and 44 when the invention is in the box format, thereby making for easier folding.

Third, there is a pressure-reducing slit 5 6 disposed at the end of fold line 26 at vertex point 54. In the box format (FIG. 2), slit 56 allows the corners of bottom panel 20 to angle slightly downward, thereby releasing the pressure at vertex point 54.

Figure 3:
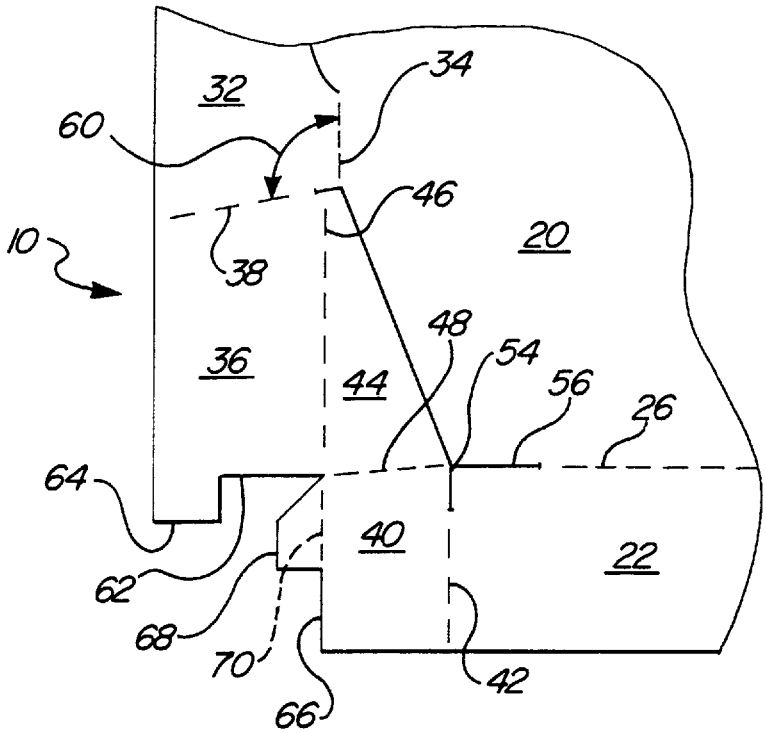
FIG. 3 is a plan view of a partial section of the blank.

Fourth, fold line 38 is disposed at an obtuse angle 60 to fold line 34 (shown in FIG. 3). This causes side wall 32 to slope slightly inward at the fold line and, thereby, offset the tendency for the wall to angle outwards in the middle section.

Fifth, fold line 52 is disposed at an obtuse angle 61 to fold line 34 (shown in FIG. 1). This causes flap 50 to slope upward from fold line 52 when flap 50 is disposed perpendicular to side wall 32 which, in turn, causes side wall 32 to slope slightly inward at the rear end. In the preferred embodiment, angle 61 is only a degree or two over 90 degrees and, therefore, may not be apparent in the drawing.

Sixth, in the blank format, major diagonal wall 36 has an irregular end edge comprising an inward portion 62 that is substantially aligned with fold line 48 and an outward portion 64 that lies forward of line 48.

Seventh, minor diagonal wall 40 also has an irregular end edge, which comprises an inward portion 66 that is substantially aligned with fold line 46 and an outward portion 68 that is disposed on an exterior side of an imaginary line of projection 70 (seen in FIG. 3) which extends from fold line 46.

The result of the unique end edge structure (62, 64, 66, 68) is that, in the box format (FIGS. 2 and 4), minor diagonal wall 40 abuts end edge 62 of major diagonal wall 36 and major diagonal wall 36 overlaps minor diagonal wall 40. Further, it is noted that, because of this arrangement, end edge 62 is adjacent minor diagonal wall 40.

A cover 80 comprises a D-shape cover panel 82 hingedly attached at a rear edge 84 to rear wall 24, a cover front flap 86 hingedly attached to a front edge of cover panel 84 at a fold line 88, a pair of approximately parallel free side edges 96 disposed adjacent rear edge 84, and a pair of opposing free diagonal edges 98 extending from side edges 96 to the front fold line edge (88). It is noted that the free side edges and free diagonal edges in combination with a single cover front flap make cover 80 unique in the industry and give it the capability of being closed with extreme speed and ease compared to the multi-flap covers of other D-type boxes.

(Please note that, in the drawings, numeral 84 also indicates the position of the fold line connecting panel 82 to wall 24.)

An easy-grasp tab 90, which in the blank format is surrounded by flap 86, projects forward from fold line 88. As shown in FIG. 2, tab 90 has a width 92 and a depth 94. To provide adequate grasping surface, width 92 is at least 35 millimeters and depth 94 is at least 18 millimeters. The primary purpose of easy-grasp tab 90 is to provide a means for easily grasping the box for extracting it from a line-up of vertically disposed boxes. Secondarily, it provides a means for easily raising the box cover with one hand.

Cover panel 82 is equipped with anti-warp score lines 100. These are an optional feature which can be omitted if desired. For more information on anti-warp score lines, see my U.S. Pat. No. 5,806,755, entitled "Product-protecting Pizza Carton."

It should be noted that cover panel 82 is wider than bottom panel 20. Therefore, as can be seen in FIG. 2, in the box format cover panel 82 overlaps side walls 32.

To enable box 12 to stand vertically on its side, a stand-up tab 99 projects from each side of bottom panel 20. Tab 99 extends outward from side wall 32 by approximately the distance that cover panel 82 overlaps side wall 32, thereby enabling the box to stand on its side perpendicular to a support surface, such as a shelf or table.

Within this specification and the ensuing claims several definitions have been used. To insure clear meaning, they are defined here.

A "D-type box" is a box having opposing front and rear walls and opposing left and right side wall structures each comprising a side wall disposed adjacent the rear wall and a diagonal wall disposed adjacent the front end of the side wall. Additional panels may or may not be part of the side wall structure.

A "D-shape cover panel" is a cover panel having a rear edge, a front edge of shorter length than the rear edge, approximately parallel left and right side edges adjacent said rear edge, and opposing left and right diagonal edges extending from the side edges to the front edge. The diagonal edges may be straight, curved, or curvilinear.

A "free-side-edge cover panel" is a cover panel having side edges that are free of attachment to any flaps.

Within the context of this invention, a fold line can be created by a number of means such as, for example, by a crease or score in the board, by a series of aligned spaced short slits in the board, and by a combination of aligned spaced short and long slits. Also, it's possible to create a flip-vent along a fold line by locating a U-shaped slit in the middle of the fold line. When this occurs, the slit, or flip-vent, is considered to be part of the fold line. In short, as referred to herein, a fold line is any line between two points on the blank or box along which the board is intended to be folded when the blank is being erected into a box. The type of fold lines shown in the drawings are presently preferred but it will be appreciated that other methods known to those skilled in the art may be used.

METHOD OF USE

One expeditious method of erecting blank 10 into box 12 is as follows. First, fold rear corner flaps 50 slightly inward.

Second, hold the blank vertically with the cover down, the outside surface facing you, and hands placed at the forward end of side wall structures 30 where side wall 32 joins major diagonal wall 36. Position your thumbs on the major diagonal walls 36. Third, simultaneously fold side walls 32 and major diagonal walls 36 inward and to upright position. In doing this, minor diagonal walls 40 and front wall 22 will assume a semi-upright position. Fourth, move your hands to front wall 22 and fold it to full upright position. Fifth, with hands on front wall 22, roll the tray portion of the box forward and down while bracing rear wall 24 against the abdomen. After doing this, cover panel 82 will now be almost closed on the box. Finally, fold front cover flap 86 inward and tuck it into the space (gap 58) behind front wall 22.

To open the box with one hand, place finger tips on the top edge of front wall 22 and with the thumb push up on tab 90.

If anti-warp score lines 100 have been included in cover panel 82, the score lines can be "activated" by bending the cover panel inward along the lines. This eliminates any warp that might be present in the panel and also raises the center of the panel slightly, creating a crown effect.

CONCLUSION, RAMIFICATIONS, AND SCOPE

I have disclosed a carton having:

(a) a unique quick-closing, easy-to-use cover structure for a D-type box, the cover structure comprising a cover panel having side edges and diagonal edges free of attachment and a cover flap attached to a front edge of the cover panel;

(b) a unique side wall structure for a D-type box, that side wall structure comprising a side wall, a major diagonal wall, a minor diagonal wall, a connector panel, and a corner flap attached to a rear end of the side wall;

(c) a unique structural arrangement of major and minor diagonal walls whereby the minor diagonal wall abuts an end of the major diagonal wall;

(d) an easy-grasp tab on a cover panel;

(e) a unique fold line structure for relieving pressure at a vertex point where a bottom edge of an end wall converges with a side edge of a minor diagonal wall.

The illustrated number, size, shape, type, and placement of components represent the preferred embodiment; however, many other combinations and configurations are possible within the scope of the invention. Following are some examples.

In the preferred embodiment the easy-grasp tab is semi-circular. However it could take other shapes, as well, and if it were another shape it would be considered to be within the scope of this invention as long as it had the necessary width and depth dimensions to qualify as an easy-grasp tab.

In the box format of the preferred embodiment, major diagonal wall 36 overlaps minor diagonal wall 40. However, it's possible to rearrange, or "reverse," the inward and outward portions (62, 64, 66, 68) of the end edge structure of both walls so that minor diagonal wall 40 overlaps major diagonal wall 36, instead. If such were done it would be considered to be within the scope of this invention.

In the preferred embodiment, cover diagonal edges 98 are curved; however, they could be straight, instead. If such were the case it would be considered to be within the scope of this invention.

In the preferred embodiment, anti-warp score lines 100 are in an X-shape configuration. Other configurations can be used and such would be considered to be within the scope of this invention. For other anti-warp score line configurations, see my U.S. Pat. No. 5,806,755, entitled "Product-protecting Pizza Carton."

The foregoing discussion has pertained mainly to packaging relatively flat food products such as pizza. However, it should be realized that my invention could be used for other purposes, as well. In conclusion, it is understood that the invention is not to be limited to the disclosed embodiments but, on the contrary, is intended to cover various modifications and equivalent arrangements included within the spirit and scope of the appended claims.

I claim:

1. A D-type box having a unique easy-to-use D-shape cover structure, said box being of foldable material and comprising:

a bottom panel, opposing front and rear walls, opposing first and second side wall structures each comprising a side wall disposed adjacent said rear wall, a major diagonal wall hingedly attached to a front end of said side wall, a minor diagonal wall hingedly attached to an end of said front wall, and a connector panel hingedly attached to a bottom edge of each of said major and minor diagonal walls, a cover hingedly attached to said rear wall and comprising:

(a) a D-shape cover panel having front and rear edges, approximately parallel first and second side edges disposed adjacent said rear edge, and opposing first and second diagonal edges extending from said first and second side edges, respectively, to said front edge, wherein said first and second side edges and said first and second diagonal edges are free of attachment, (b) a flap hingedly attached to said front edge;

whereby said D-type box can be easily and quickly erected from a blank and can be easily and quickly closed from an open or partially-erected box format.

2. The D-type box of claim 1 wherein:

each of said first and second side wall structures further comprises a free-swinging corner flap hingedly attached to a rear end of said side wall and disposed parallel to said rear wall.

3. The D-type box of claim 2 wherein:

in each of said first and second side wall structures the side wall is hingedly attached to said bottom panel at a first fold line and the freeswinging corner flap is hingedly attached to said side wall at a second fold line, wherein said second fold line is disposed at an obtuse angle to said first fold line.

4. The D-type box of claim 1 wherein:

said bottom panel has at least one standup tab projecting therefrom and disposed adjacent one of said first and second side wall structures.

5. The D-type box of claim 1 wherein:

said cover panel has a tab projecting from said front edge and overlapping a top edge of said front wall.

6. The D-type box of claim 1 wherein:

a substantial gap exists between an end edge of said major diagonal wall and said front wall, said gap being at least six millimeters.

7. The D-type box of claim 1 wherein:

said minor diagonal wall abuts and an end of said major diagonal wall.

8. The D-type box of claim 1 wherein:

in each of said first and second side wall structures the side wall is hingedly attached to said bottom panel at a first fold line and the major diagonal wall is hingedly attached to said side wall at a second fold line, wherein said second fold line is disposed at an obtuse angle to said first fold line.

9. The D-type box of claim 1 wherein:

said cover panel contains anti-warp score lines.

10. A non-rectangular box having an improved side wall structure, said box being of foldable material and comprising:

a bottom panel, an end wall hingedly attached to said bottom panel at a first fold line, a side wall structure comprising:

(a) a side wall hingedly attached to said bottom panel at a second fold line, (b) a major diagonal wall hingedly attached to an end of said side wall at a third fold line and disposed at an obtuse angle to said side wall, (c) a minor diagonal wall hingedly attached to an end of said end wall at a fourth fold line and disposed at an acute angle to said end wall, (d) a connector panel hingedly attached to a bottom edge of each of the major and minor diagonal walls; wherein said minor diagonal wall abuts an end edge of said major diagonal wall, whereby when said minor diagonal wall is pushed toward the major diagonal wall the minor diagonal wall is rendered stationary as a result of abutting the end edge of the major diagonal wall.

11. The box of claim 10 wherein:

said major diagonal wall abuts an end of said minor diagonal wall, whereby a portion of one of the major and minor diagonal walls overlaps a portion of the other of said major and minor diagonal walls.

12. The box of claim 10 wherein:

said third fold line is disposed at an obtuse angle to said second fold line.

13. The box of claim 10 wherein:

said connector panel is free of attachment to said bottom panel.

14. The box of claim 10 further comprising:

a cover comprising a cover panel having a front edge and a tab projecting from said front edge and overlapping a top edge of said end wall.

15. The box of claim 10 further comprising:

a cover comprising:

a cover panel having a front edge, first and second side edges, and first and second diagonal edges, said first and second side edges and said first and second diagonal edges being free of attachment, a cover front flap hingedly attached to said front edge and disposed adjacent said end wall.

16. The box of claim 10 wherein:

said bottom panel has at least one stand-up tab projecting therefrom and disposed adjacent said side wall structure, said at least one stand-up tab being part of said bottom panel and being free of attachment to any other panel of said box.

17. The box of claim 10 wherein:

said first fold line adjoins said fourth fold line at a vertex point, said first fold line comprises a slit extending from said vertex point.

18. A blank for a non-rectangular box having an improved side wall structure, said blank being of foldable material cut and scored to define:

a bottom panel, an end wall hingedly attached to said bottom panel, a side wall structure comprising:

(a) a side wall hingedly attached to said bottom panel, (b) a major diagonal wall hingedly attached to an end of said side wall, (c) a minor diagonal wall hingedly attached to an end of said end wall, (d) a connector panel hingedly attached to a bottom edge of the major and minor diagonal walls at first and second fold lines, respectively, said minor diagonal wall being shorter than said major diagonal wall;

wherein at least a portion of said minor diagonal wall is disposed on an exterior side of an imaginary line of projection extending from said first fold line, whereby after the blank has been erected into a box said minor diagonal wall abuts an end edge of said major diagonal wall.

19. The blank of claim 18 wherein:

said side wall structure further comprises a free-swinging corner flap hingedly attached to another end of said side wall, said free-swinging corner flap being attached only to said another end of said side wall and being free of attachment to any other panel of said blank.

20. A blank for a non-rectangular box having an improved side wall structure, said blank being of foldable material cut and scored to define:

a bottom panel, an end wall hingedly attached to said bottom panel, a side wall structure comprising:

(a) a side wall hingedly attached to said bottom panel, (b) a major diagonal wall hingedly attached to an end of said side wall, (c) a minor diagonal wall hingedly attached to an end of said end wall, (d) a connector panel hingedly attached to a bottom edge of the major and minor diagonal walls at first and second fold lines, respectively, said minor diagonal wall being shorter than said major diagonal wall;

wherein said major diagonal wall has an end edge free of attachment and at least a portion of said end edge is approximately aligned with said second fold line, whereby after the blank has been erected into a box said at least a portion of said end edge is disposed adjacent said minor diagonal wall.

21. The blank of claim 20 wherein:

said side wall structure further comprises a free-swinging corner flap hingedly attached to another end of said side wall.

22. A box having an improved fold line structure, said box being of foldable material and comprising:

a bottom panel, a wall hingedly attached to said bottom panel at a first fold line, a panel hingedly attached to an end of said wall at a second fold line and disposed at an angle to said wall, said second fold line adjoining said first fold line at a vertex point;

wherein said first fold line comprises a slit at least 5 millimeters long extending from said vertex point, whereby there is less pressure at the vertex point than would exist if said first fold line did not contain said slit.

23. A blank for a pizza box having an easy-grasp cover tab, said blank being of foldable material cut and scored to define:

a bottom panel, opposing front and rear walls hingedly attached to said bottom panel, opposing first and second side wall structures each comprising a side wall hingedly attached to said bottom panel, a cover hingedly attached to said rear wall and comprising a cover panel and a cover front flap hingedly attached to a front edge of said cover panel at a fold line, said cover panel having at least one tab projecting forward of said fold line and surrounded by said cover front flap;

wherein said tab is at least 35 millimeters wide and projects forward of said fold line by at least 18 millimeters, whereby after said blank has been erected into a pizza box said box can be grasped at the tab and easily removed from a lineup of vertically-disposed boxes.

24. The blank of claim 23 wherein:

each of said first and second side wall structures further comprises a major diagonal wall hingedly attached to an end of said side wall.

* * * * *